US005375490A

United States Patent [19]

Carlmark

[11] Patent Number: 5,375,490

[45] Date of Patent: Dec. 27, 1994

[54] ADJUSTABLE SPANNER OR SIMILAR GRIPPING DEVICE

[75] Inventor: Rolf Carlmark, Bjästa, Sweden

[73] Assignee: Interconsult ICT AB, Sweden

[21] Appl. No.: 87,692

[22] PCT Filed: Jan. 9, 1991

[86] PCT No.: PCT/SE91/00013

§ 371 Date: Jul. 9, 1993

§ 102(e) Date: Jul. 9, 1993

[87] PCT Pub. No.: WO92/11975

PCT Pub. Date: Jul. 23, 1992

[51] Int. Cl.[5] ..... B25B 13/14

[52] U.S. Cl. ..... 81/133; 81/148; 81/129.5

[58] Field of Search ..... 81/58, 58.2, 59.1, 60, 81/133-135, 138-139, 141-143, 145-149, 126, 129, 129.5

[56] References Cited

U.S. PATENT DOCUMENTS 4,281,568 8/1981 Martinmaas ..... 81/134
4,454,791 6/1984 Seward, III ..... 81/133
4,653,357 3/1986 Carlmark ..... 81/133

FOREIGN PATENT DOCUMENTS 444527 4/1986 Sweden .

*Primary Examiner*—D. S. Meislin
*Attorney, Agent, or Firm*—Ostrolenk, Faber, Gerb & Soffen

[57] ABSTRACT

An adjustable or similar gripping device includes a shaft and a gripping head which has two jaws, at least one of which is moveable so as to adjust the opening between the jaws of the gripping head. At least one of the jaws has a gear rack which engages a rotatable cog. A spring on the cog urges the jaws into a gripping position. A locking device is provided selectively to prevent movement of the jaw. The locking device includes a locking member which engages between a surface on the cog and a cam located next to the cog. The locking member moves in and out of locking engagement with the cog and the cam.

10 Claims, 4 Drawing Sheets

ADJUSTABLE SPANNER OR SIMILAR GRIPPING DEVICE

BACKGROUND OF THE INVENTION

1. Field of the Invention

The present invention relates to an adjustable spanner or similar gripping device of the type which comprises a shaft or a handle and a gripping head which is defined by two jaws, of which one is preferably stationary and the other is displaceable so as to permit variation of the opening or gap of the head, at least the second jaw being provided with cogs which are in permanent mesh with cogs rotatably journalled in relation to the shaft on a wheel which is actuable by, for instance, a spring to rotate in such a direction that the jaws always strive to approach one another, the wheel co-operating with a locking or arresting device which is switchable between two positions, namely a free position in which the wheel may rotate and a locked or arrested position in which rotation of the wheel is prevented and displacement of the one jaw in relation to the other is obstructed.

2. Description of the Related Art

Swedish patent specification No. 8401884-5, filed in the same name, discloses an adjustable spanner which utilizes a specific type of coupling entitled spline coupling for realizing mechanical interconnection. This prior art coupling fundamentally suffers from two major drawbacks, namely its relatively high cost and the fact that steplessness in interconnection is difficult to achieve, since the prior art coupling is stepped by its very nature, even if the steps may be made slight and, moreover, may be further reduced by specific additional measures. However, such measures in respect of the prior art coupling have a tendency to render the coupling even more expensive.

SUMMARY OF THE INVENTION

Hence, the present invention is an arrangement which, by inherent self-homing properties, causes a gripping device, for instance an adjustable spanner, rapidly and steplessly to maneuver into gripping position, and which may also immediately impart stepless locking power to the desired gripping position.

Thus, the present invention is primarily an arrangement in which truly stepless interconnection takes place, at relatively low manufacturing costs.

In the type of adjustable spanner or similar gripping device described by way of introduction, with self-homing stepless locking position adjustment, the present invention is characterized in that the above-mentioned locking or arresting device includes a surface disposed on the wheel or connected thereto, a second surface or locking cam which is arranged to operate independently of the surface disposed on the wheel or coupled therewith, and a displaceable lock or arrest member which is located between the above-mentioned two surfaces, which converge in a locking direction.

According to one particularly advantageous embodiment of the present invention, the above-mentioned locking or arresting device is, by one of the above-mentioned two surfaces or other means of corresponding function, operative to be displaced out of locking or arrest engagement between the two surfaces, and into locking or arrest engagement between the two surfaces by at least one or both of these two surfaces, and the second surface or locking cam is arranged to be manually displaceable, such displacement being realized by means of operation of a pin suitably pretensioned by a spring, for example by depression of the pin. It is further advantageous according to the present invention if the second surface or locking cam is located in one end of an arm which is suitably placed within the spanner and is rotatably disposed on a stub shaft fixed in the spanner, and if the stub shaft for the arm is located more proximal one end of this arm, the arm being, in the proximity of its other end, pretensioned suitably by a spring to strive towards the locking direction and being operable in the opening direction by the above-mentioned pin, The nature of the present invention and its aspects will be more readily understood from the following brief description of the accompanying drawings, and discussion relating thereto.

It should, however, be observed that the figures of the accompanying drawings are not fully to scale and should, therefore, rather be considered as conceptually schematic with a view to illustrating how the apparatus according to the present invention may be basically designed.

DETAILED DESCRIPTION OF THE PREFERRED EMBODIMENT

Figure 1:
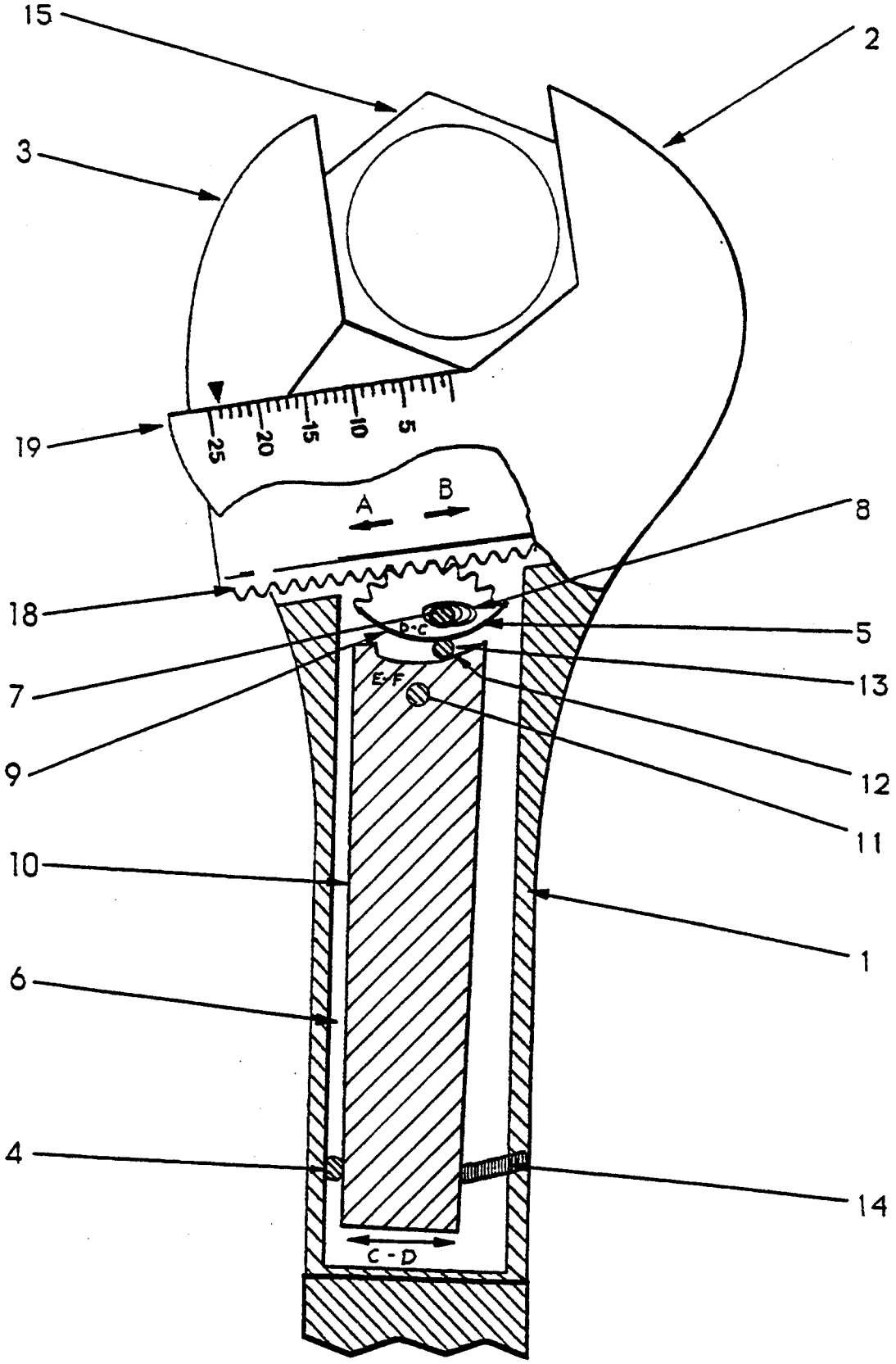
FIG. 1 is a side elevation of an adjustable spanner, certain parts having been removed for purposes of clarity, in the locked or arrest position.

Referring to the drawings, the apparatus shown in FIG. 1 consists of a selected, illustrated example comprising an adjustable spanner—even though the apparatus according to the present invention may, of course, be employed in other similar gripping devices. The apparatus fundamentally includes a shaft 1 of optional length, a stationary jaw 2 (which may, of course, be designed to be movable if desired or necessary), and a moving jaw 3, together with a locking or arresting device 13, 5, 10.

Figure 3:
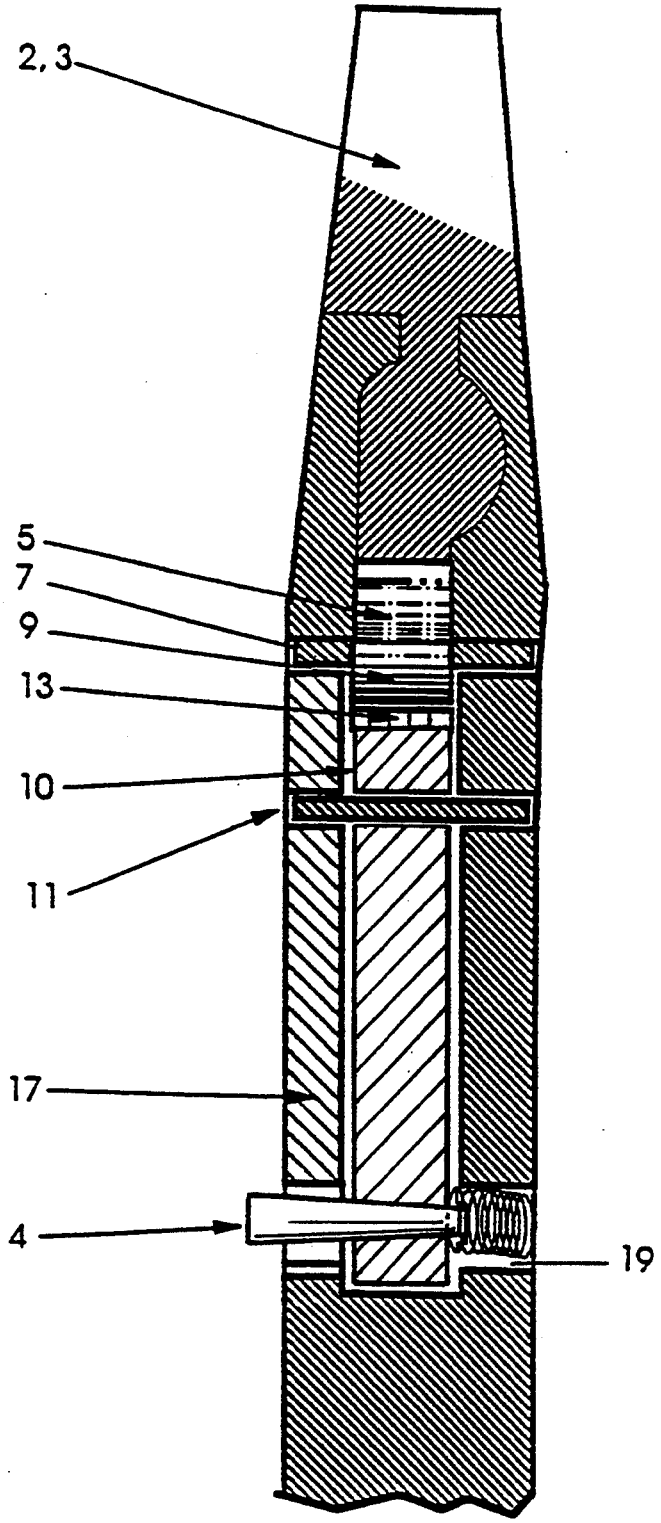
FIG. 3 is a partial section through the apparatus according to FIGS. 1 and 2.

A wheel 5 is housed in a compartment 6 in the shaft 1 of the adjustable spanner, the compartment being closed by means of a suitable lid 17 (see in particular FIG. 3), the outer surface of the wheel 5 being divided into substantially two sections, of which one section is provided with teeth or cogs and co-operates with the cogged rear side 18 of the movable jaw 3, while the second section 9 is substantially smooth and formed as a cam which has an eccentric function, as will be apparent in greater detail below.

The wheel 5 is rotatably disposed on a pin 7 which is anchored in the spanner shaft 1 and may suitably also be guided by the lid 17. The wheel 5 is always in mesh with the preferably straight gear rack 18 of the movable jaw 3, for which reason the pin 7 should be located in the center of the gear path section of the wheel 5.

The wheel 5 is further spring tensioned by means of a spring 8, suitably a coiled spring, so that the moving jaw 3 always strives to move in a direction towards the stationary jaw 2.

The second section 9 of the outer surface of the wheel 5 has, as is particularly apparent from FIGS. 4*a* and 4*b*, a different central position than the gear path section of the wheel 5, and/or a shape which results in the second section surface, in a direction from D to C, marked in FIG. 1 and particularly clarified in FIGS. 4*a* and 4*b*, acting as an eccentric cam which strives to entrain a locking member 13, see below, under certain conditions.

An arm section 10 is disposed in the compartment 6 of the spanner shaft 1, the arm section being rotatably disposed on a pin 11 whose position is, in turn, fixed by the shaft 1 and the lid 17. The forward edge surface 12 of the arm section 10 (the upper surface in the figures) is in the form of a cam which is stepped in a direction from E to F (see in particular FIG. 1, 4*a* and 4*b*), this forward edge surface being designated the locking cam 12.

The above-mentioned locking member 13 is disposed between the locking cam 12 and the second section surface of the wheel 5. The locking member 13 may, for example, consist of a roller, a ball or the like and is retained in position by the inner sides of the spanner shaft 1 and by the lid 17. The diameter of the locking member 13 is selected in relation to the varying distance between the second section 9 of the outer surface of the wheel 5 and the forward edge surface 12 of the arm section 10 such that the locking member 13 is fixedly clamped between these surfaces in one position (see FIG. 1 and 4*a*) and may run freely in another position (see FIG. 2 and 4*b*).

In connection with its rear end (the lower end in the figures), the arm section 10 is, towards its one side (the right-hand side in FIG. 1), connected to a spring 14 which strives to urge the arm section 10 to the left in FIG. 1. A pin 4 acts against the other side of the arm section 10, the pin being suitably conical (see in particular FIG. 3), and being pretensioned in a direction out of engagement with the arm section 10 (to the left in FIG. 3) by a spring 19.

Figure 4A:
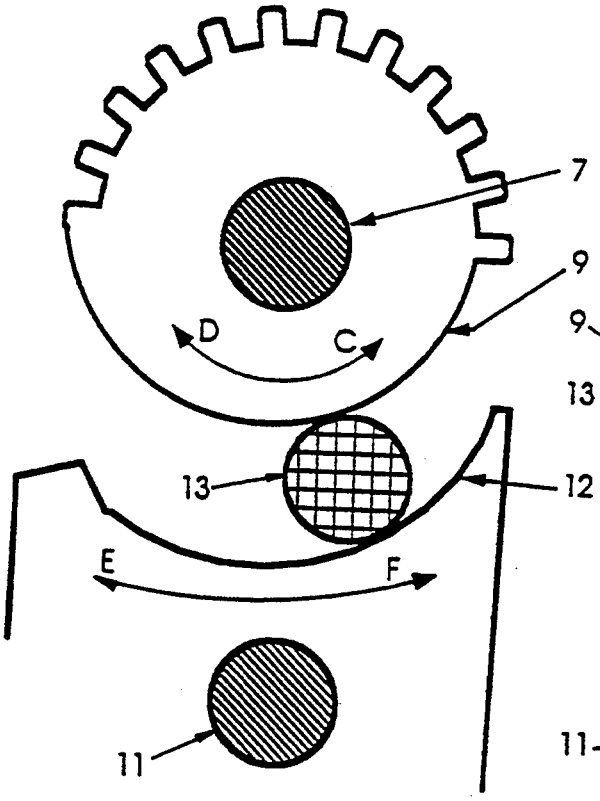
FIGS. 4*a* and 4*b* show some parts of the subject matter of the present invention according to FIGS. 1 and 2 on a larger scale for further clarifying the inventive concept as herein disclosed.

FIGS. 1 and 4*a* illustrate how the arm section 10—as a result of the action of the spring 14 and with the pin 4 disengaged—has turned its locking cam 12 so that the locking member 13 has been displaced into the locking or arrest position between the locking cam 12 and the second section surface 9, the eccentric shape of this second section surface 9 fixedly clamping the locking member 13—when the moving jaw 3 strives to be displaced under load—whereby the moving jaw 3 is arrested and locks against a bolt head 15 or a nut.

Figure 2:
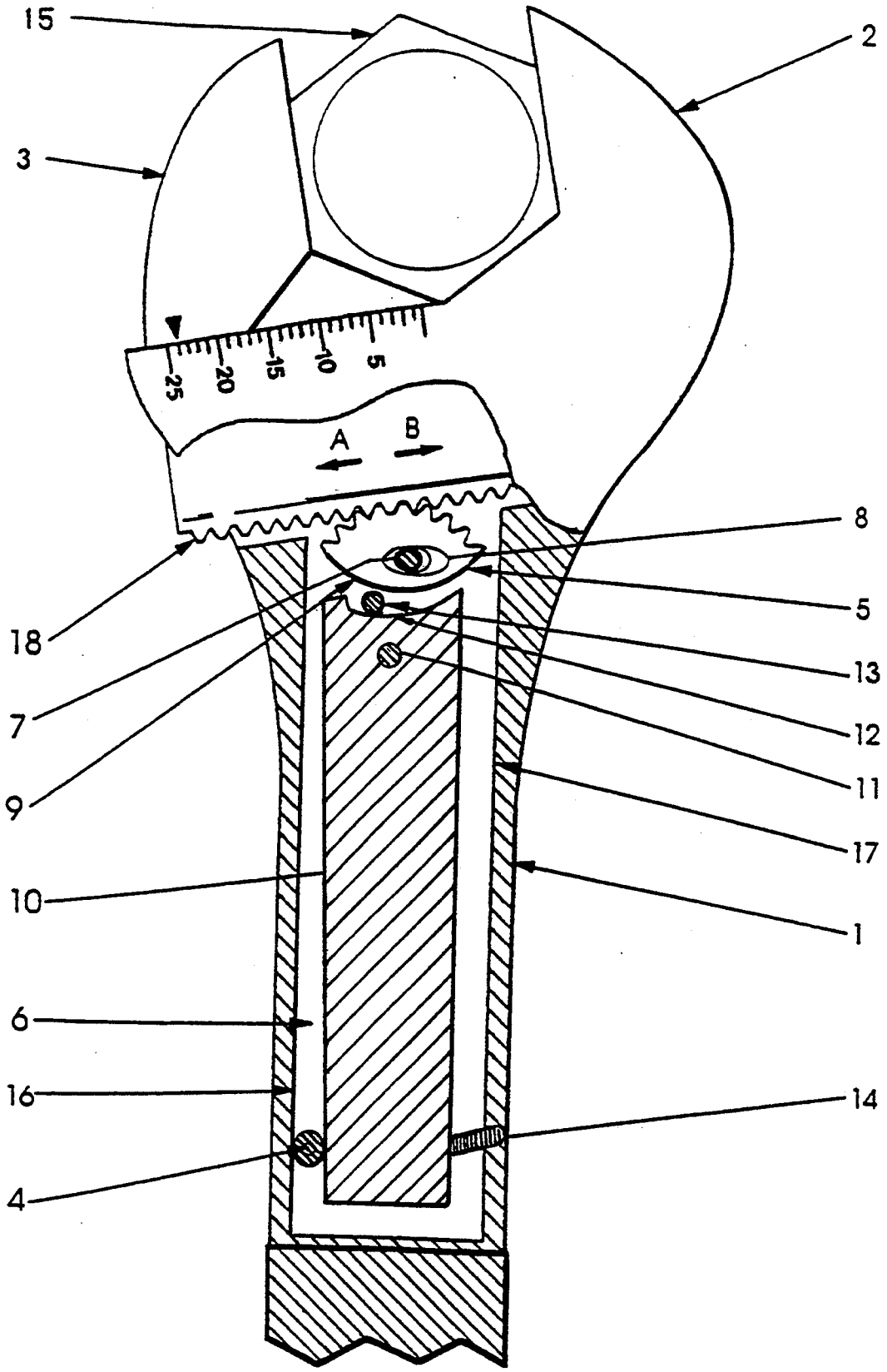
FIG. 2 is a view corresponding to that of FIG. 1 but in the opened or free position.
Figure 4B:
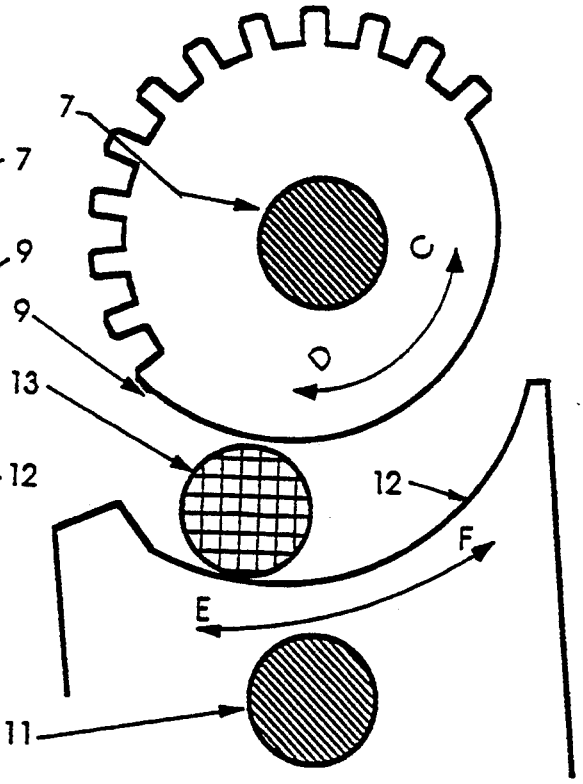

FIGS. 2 and 4*b* illustrate the reverse situation—on manual depression of the pin 4—with the locking member 13 disengaged, in which the depression of the pin 4 between the wall 16 and the side edge of the arm section 10 has resulted in the arm section 10 being turned against the action of the spring 14 so that the locking cam 12 has been forced away from the locking member 13 out of locking co-operation with the second section surface 9 of the wheel 5. However, it should here be observed that FIG. 4*b* shows a greater distance between the jaws 2 and 3 than is fundamentally illustrated in FIG. 2 by the key width of the bolt head 15.

Consequently, the above-described adjustable spanner can only be operated with the aid of the movable pin 4. As soon as the pin 4 is manually depressed, the locking or arrest member 13 is moved into a disengaged position, whereby the moving jaw 3 is freed and may be moved by the action of the spring 8 in a direction towards the stationary jaw 2 or, alternatively, by an outer pressure on the inside of the moving jaw 3 (for example by forcing the jaws 2, 3 against the pointed edge of a bolt head), is moved against the action of the spring 8 in a direction away from the stationary jaw 2. When manual depression of the pin 4 ceases, the locking or arrest member 13 is displaced by the locking cam 12 to such a position that the second section surface 9 of the wheel 5 forces the locking or arrest member 13 into locking engagement with the locking cam 12, as indicated in FIGS. 1 and 4*a*.

When the adjustable spanner according to the present invention is employed, for example the thumb of the operator may press in the pin 4 and move the jaws 2, 3 towards one corner or point of a bolt head, the tips of the jaws 2, 3 being forced apart so that the jaws 2 and 3 open sufficiently i against the action of the spring 8) that they grasp about the sides or flats of the bolt head 15 under a pressure which is generated by the spring 8. As soon as the jaws 2 and 3 have exactly gripped the flats of the bolt head 15 (key width), the depression on the pin 4 is released, whereupon the moving jaw 3 is immediately locked in accordance with the above description. The adjustable spanner is now ready to begin work by turning the bolt 15 right or left-handedly, as required.

When a new turn is needed—for example for reasons of space—the jaws 2, 3 need not be disengaged from the bolt head 15, but a new turn can always be made by pressing the pin 4 and releasing it when the shaft i has assumed the desired and intended position, from which it follows that the present invention also acts in a manner similar to a so-called ratchet handle.

A suitably graded gauge 19 is advantageously provided on one or both sides of the spanner, whereby the present invention may also act and be employed as a self-positioning measurement gauge.

The embodiment described in the foregoing and shown on the drawings illustrates that the adjustable spanner will be self-adjusting as a result of its striving to enter locking position steplessly.

Because the adjustable spanner according to the present invention also works as a ratchet handle, it may, moreover, be employed as a substitute for a ring spanner, implying the advantage that it is possible, for example, to work from the side, mounted on, for instance, an extension bar.

As an alternative, the above-described arm section 10 with its locking cam 12 may, for example, possibly be stationary and the locking or arrest member 13 may be spring-biased to locking or arrest engagement and can, instead, be directly actuable in the opposite direction by the pin 4. Other designs and variations are, of course, possible without departing from the spirit and scope of the appended claims.

All loaded surfaces and parts must, of course, be dimensioned for the intended loads and exposed parts should ideally, be of tempered tool steel.

Thus, the adjustable spanner described in the foregoing functions as an open ended spanner, an adjustable spanner, a ring spanner and as a measurement gauge, whose operation is merely effected by depressing a pushbutton in the form of, for example, a pin. Hence, no difficulties will be experienced in operating the spanner while wearing thick gloves, and even seriously handicapped users are capable, in many cases, of employing the present invention.

The present invention should not be considered as restricted to that described above and shown on the drawings, many modifications being conceivable without departing from the spirit and scope of the appended claims.

I claim:

1. An adjustable gripping device comprising:
a shaft;
a gripping head, mounted on the shaft, comprising:
a stationary jaw; and
a movable jaw, including a gear rack;
a cogged wheel rotatably mounted on the shaft, the cogs on the wheel engaging the gear rack;
means for continuously urging the moveable jaw toward the stationary jaw;
locking means for selectively preventing movement of the moveable jaw, the locking means comprising:
a surface on the wheel;
a cam spaced from the surface on the wheel so as to define a gap between the surface of the wheel and the cam, the gap narrowing in a locking direction; and
a locking member movable within the gap, the moveable jaw being locked in place when the locking member is wedged between the wheel surface and the cam in the gap.

2. The adjustable gripping device as claimed in claim 1, wherein the cam is disposed to be manually movable, such movement realized by maneuvering of a pin pretensioned by a spring.

3. The adjustable gripping device as claimed in claim 1, wherein the cam is disposed in one end of an arm suitably placed within the spanner, said arm being rotatably disposed on a stub shaft secured in the gripping device.

4. The adjustable spanner as claimed in claim 1, wherein the wheel surface is disposed in one end of an arm suitably placed within the spanner, said arm being rotatably disposed on a stub shaft secured in the gripping device.

5. The adjustable gripping device of claim 1, further comprising means for manually moving the locking member into and out of wedged engagement between the wheel surface and the cam within the gap.

6. The adjustable gripping device of claim 1, further comprising means for moving the cam into and out of wedged engagement with the locking member.

7. The adjustable gripping device of claim 1, further comprising means for displacing the wheel surface into and out of wedged engagement with the locking member.

8. The adjustable gripping device of claim 1, wherein the cam is rotatably mounted on the shaft.

9. The adjustable gripping means of claim 6, further comprising second spring means for biasing the cam into wedged engagement with the locking member.

10. The adjustable gripping means of claim 9, wherein the means for moving the cam out of wedged engagement with the locking member acts in a direction opposite to the biasing of the second spring means.

* * * * *